US008943943B2

(12) United States Patent
Tassaroli

(10) Patent No.: US 8,943,943 B2
(45) Date of Patent: Feb. 3, 2015

(54) EXPLOSIVE CARRIER END PLATES FOR CHARGE-CARRIERS USED IN PERFORATING GUNS

(71) Applicant: Tassaroli S.A., Mendoza (AR)

(72) Inventor: Carlos Jose Tassaroli, Mendoza (AR)

(73) Assignee: Tassaroli S.A., Mendoza (AR)

( * ) Notice: Subject to any disclaimer, the term of this patent is extended or adjusted under 35 U.S.C. 154(b) by 90 days.

(21) Appl. No.: 13/672,801

(22) Filed: Nov. 9, 2012

(65) Prior Publication Data

US 2013/0118342 A1 May 16, 2013

(51) Int. Cl.
*F41F 5/00* (2006.01)
*E21B 43/116* (2006.01)
*E21B 43/119* (2006.01)

(52) U.S. Cl.
CPC ..... *E21B 43/116* (2013.01); *E21B 43/119* (2013.01)
USPC ..... 89/1.15; 175/4.55; 175/4.56; 175/4.57; 175/4.58; 175/4.59

(58) Field of Classification Search
CPC . E21B 43/117; E21B 43/119; E21B 43/1185; E21B 43/116; E21B 43/1195; E21B 43/11852; E21B 43/11855; E21B 29/02; E21B 43/11; E21B 43/14; E21B 17/07; E21B 34/063; E21B 43/11857; E21B 47/12; E21B 33/13; E21B 33/138
USPC ..... 89/1.15; 175/4.55–4.59
See application file for complete search history.

(56) References Cited

U.S. PATENT DOCUMENTS

| | | | | |
|---|---|---|---|---|
| 2,833,213 | A * | 5/1958 | Udry | 175/4.6 |
| 4,850,438 | A * | 7/1989 | Regalbuto | 175/4.56 |
| 2013/0118342 | A1* | 5/2013 | Tassaroli | 89/1.15 |
| 2014/0096670 | A1* | 4/2014 | Bell et al. | 89/1.15 |

* cited by examiner

*Primary Examiner* — Samir Abdosh
(74) *Attorney, Agent, or Firm* — Frommer Lawrence & Haug LLP; William S. Frommer

(57) ABSTRACT

Explosive carrier end plates for charge-carriers utilized in guns for the perforation of petroleum producing wells. Each gun is mounted coupled vertically with similar guns inside the casing of the well, and each gun is a hollow cylinder in the interior of which there is a corresponding tubular carrier that has multiple peripheral mountings for a radial placement of the shaped-charges. The carrier is mounted in the gun by means of a top insulating end plate that has a retractable electrical spring contact capable of pushing upwards, and a bottom insulating end plate. The end plates have a centering clip for anchoring in a respective window of the cylindrical wall of the carrier. Both end plates have a single removable insert axially fitted between two tubular inserts, which present reciprocal guiding and positioning means for a pin-keyway slot to enable mounting with the end plate. A pin and groove are provided between the peripheral cylindrical walls of end plates and the gun's wall, for anchoring in and positioning the end plate to guide the exit of each jet of the shaped charges.

9 Claims, 6 Drawing Sheets

EXPLOSIVE CARRIER END PLATES FOR CHARGE-CARRIERS USED IN PERFORATING GUNS

FIELD OF THE INVENTION

The present invention relates to assemblies of guns used in the petroleum industry for the perforation of wells and, more particularly, it is directed to convenient improvements on explosive carrier end plates for charge-carriers used in guns for the perforation of petroleum producing wells.

The process of well perforation consists of the perforation of the metallic casing of the well, of the isolating cement surrounding the casing, and of the layers of rock in the producing formation by means of explosives housed within perforating-guns; achieving, through bore holes produced by shaped charges, a connection between the depths of the producing zone and the interior of the well.

BACKGROUND OF THE INVENTION

The perforation of petroleum producing wells is realized by lowering into the well various metallic perforating-guns of different lengths, the respective charge carriers of which are charged with shaped charges, connected by joints and fired in a vertical fashion, one after another, resulting in a single unit of joined perforating-guns for the perforation of various zones, in a single lowering.

Each perforating-gun contains a 'carrier tube' or charge carrier in which shaped charges, for use in the petroleum industry, of varying geometries are set, Each of the shaped charges detonate conjointly as the charges are in contact with a detonating cord, formed by a sheath containing in its interior a granular explosive with controlled properties, through which the deflagration advances initiated by an electronic detonator, The explosion of the detonating cord detonates the shaped charges sympathetically.

Perforating guns are detonated one at a time beginning from the bottom and continuing in an upward fashion. After each detonation, the gun assembly is repositioned vertically in such a way that the lowest gun that remains active is located at the desired depth of perforation.

The detonator of each gun is activated by an electronic signal sent from the surface to the mouth of the well, by way of an electronic cable, the conductor of which is protected by a steel wire-mesh. Despite having but a single conductive wire to carry any electrical tension to the gun assembly, the charge is passed through diodes and polarized after the detonation of the bottom gun, so as to ensure that the electric current only arrives at the desired gun.

The arming of the guns, i.e., the mechanical assemblage and the electrical connections of the assembly to establish the required firing sequence, is carried out at the wellhead, usually under unfavorable general conditions, making it necessary to provide means to simplify both the arming and the electromechanical connections in order to avoid human error.

Argentine patent application P110102655 discloses a pressure activated electromechanical changeover switch providing the electrical connection. The switch has a conductive dart, which is activated at a predetermined pressure set by a mechanical fuse in the shape of an expendable ring that breaks under stress from the explosion. On receiving the impact produced by the explosion of the shaped charges located in the charge carriers of the lowest active gun in the gun assembly, the dart breaks the mechanical fuse and trips the switch. The dart acts as a switch between contacts that are exposed in the housing of the apparatus and releases the detonator from short-circuit and ground, connecting the detonator of the gun immediately above the fired gun to the circuit. This allows said detonator to later receive the electronic tension, albeit with opposing polarity to the previous gun. This switch, while it is in its initial position, in repose, before moving, allows the electrical charge, positive or negative, to reach the bottom gun and maintains the remaining and unfired portion of the gun assembly short-circuited and grounded.

It is also disclosed in the referred application P110102655 that, in each gun, each charge carrier is limited by two insulating and centralizing end plates: the bottom with a central orifice through which the firing line and the unit ground to a tab located on the outer edge of the end plate pass, placing the unit ground in contact with the outer shell of the gun, which acts as the ground for the entire gun assembly (bottom end plate without retractable contact pin), both cables are tied to a connector; and the top end plate that has a spring-loaded electrical contact pin which function is, on one hand, to assure constant electrical contact with the preceding switch, in spite of variances in lengths that can be produced, and on the other, to prevent failure of the cables that connect the guns due to twisting, as frequently occurs with current practices. The bottom plate without said pin, serves to connect the ground to the gun assembly, and to space and centralize the charge carrier within the gun. Both end plates serve to protect the elements that form the series of guns (top sub, tandem sub, and bottom sub) from fragments produced by the explosion, in such a way that these parts may be used again.

In the referred Argentine patent application P110102655, the top and bottom end plates of each carrier comprise cylindrical pieces with diameters greater than their height, the exterior of which is a cylindrical surface of a diameter that is intermediate between the inner diameter of the hollow cylinder of each gun and the external diameter of the respective carrier tube. Each piece has a means to center the carrier and an annular recess that is aligned with the corresponding end of the carrier.

The existing end plates used in TCP systems (tubing-conveyed perforation) have a fixed insert (the end plates and inserts are currently made of aluminum and steel, and formed by various pieces). In order to be able to use them in the so-called Wireline Systems, the inserts must be removed and the retractable contact pin with the wiring contact screw must be placed in the top of the assembly.

SUMMARY OF THE INVENTION

This Summary is provided to introduce a selection of concepts in a simplified Rim that are further described below in the Detailed Description. This Summary is not intended to identify key features or essential features of the claimed subject matter, nor is it intended to be used as an aid in determining the scope of the claimed subject matter.

The improvements proposed, according to the present invention, are characterized by a new constructive solution for the end plates, incorporating three clips, which, when placed in an adequate fashion on the periphery of said end plates, having been designed with certain elastic properties, automatically center each charge carrier in the respective gun.

Furthermore, according to the present invention, the centering clips are designed to anchor the end plates to the carrier at the moment of their insertion into the gun assembly; similarly, the arrangement of the centering clips is such that they establish a connection of the electrical ground between the charge carrier and the interior of the gun. To carry the electrical ground to the carrier connector, it is enough to simply attach a cable whose end is trapped between the carrier and the surface of the end plate.

Always in accordance with this invention, included in each end plate is an axial cavity with an interlocking pin-and-keyhole anchoring system—consisting of a linear rib on the inside of the orifice and a receiving 'ridge' on the insert—for a quick and unequivocal mounting of the corresponding insert. One of the inserts contains an electrical retractable contact pin, typically located on the top end plate of each carrier, while the other insert simply contains a tubular orifice to permit the passage of wires, to be used in the bottom end plate. With these improvements, the end plate orifices have differentiated dimensions for their respective interlocking pin-and-keyhole apparatus wherein either the contact pm or the insert slide.

The dimensions of the corresponding ribs are different to ensure that the retractable contact pin can only be placed in the top end plate; therefore, this system avoids the risk that the retractable assembly could be mounted in the bottom end plate by mistake as the rib will not fit into the keyhole of the insert. However, as these end plates and their inserts may be utilized interchangeably in Wireline Perforating and in Tubing-Conveyed Perforating (TCP), it is possible to locate the bottom insert into both ends of the carrier system to fit the needs of the chosen perforation method.

Also in accordance with the current invention, the exterior cylindrical wall of the end plate has a groove, or keyhole. Upon placing the charge carrier in its entirety inside the gun, the groove is aligned with an anchoring pin at the bottom of the gun, which assures accurate orientation of the jet charges with notches on the exterior of the gun (these notches are also known as 'scallops' in industry jargon). Because of the location of the anchoring pin at the bottom of the gun, the charge carrier can only be loaded into the gun through one side.

Other characteristics and advantages of the invention shall be explained in the following paragraphs.

DESCRIPTION OF THE DRAWINGS

In the attached figures.

In all figures, like reference numbers represent corresponding or substitute elements.

Figure 1:
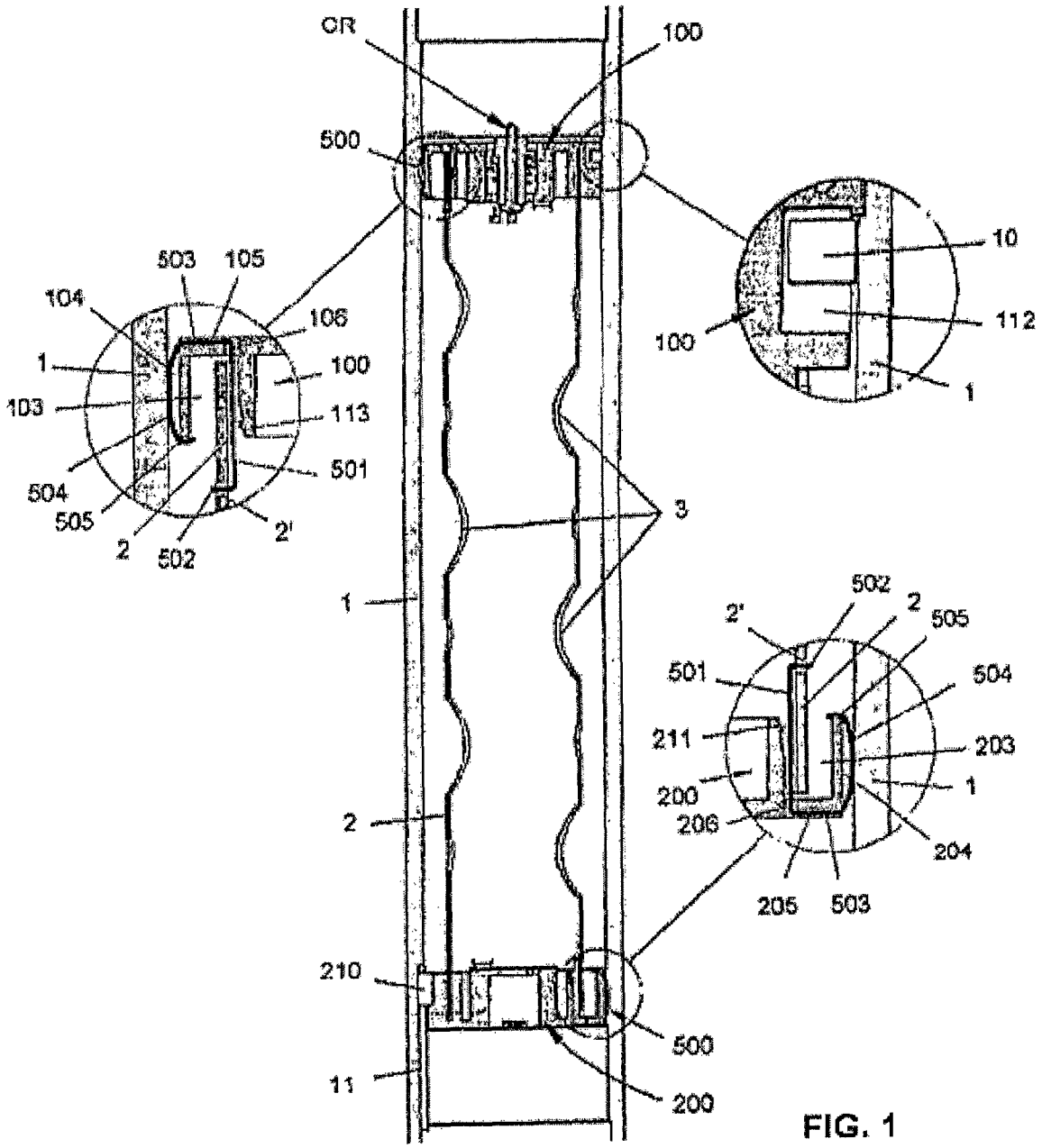
FIG. 1 is a schematic cross-section of a perforating gun and its interior charge carrier with a pair of end plates (top and bottom), according to this invention, including enhanced details of the end plates.

LIST OF MAIN REFERENCES (1) Perforating gun
(2) Charge carrier
(2') Anchoring slots for the end plates (100) and (200)
(3) Openings for the shaped charges
(10) Pin attached to gun wall for fitting and positioning the end plate (100)
(11) Guide for the locking pin in the wall of gun 1
(100) Top end plate
(101) Central opening passage of (100)
(102) Wall limiting one end of (101)
(102') Axial orifice of (102)
(103) Concentric annular rabbet to fit the corresponding end of charge carrier (2)
(104) Straight rabbets in the exterior wall of (100), parallel to the axis of the piece and offset by 120°
(105) Minor segments of recesses—prolongations of (104)—arranged radially in a way that closes one end of (100)
(106) Junctions that connect each section of the recess (105) with the concentric annular rabbet (103)
(107) Pin to guide and position the insert (300)
(108) Retention screw for insert (300) in opening (101)
(109) Central contact screw (CR)
(110) Tip of screw (109)
(111) Connection terminal
(112) "Keyhole"/groove in the outer wall of (100), to fit (10)
(113) Beveled portion of the interior wall of the concentric annular rabbet (103)
(200) Bottom end plate
(201) Central opening passage of (200)
(202) Wall limiting one end of (201)
(202') Axial orifice of (202)
(203) Concentric annular rabbet to fit the corresponding end of charge carrier (2)
(204) Straight rabbets in exterior wall of (200), parallel to the axis of the piece and offset by 120°
(205) Minor segments of recesses—prolongations of (204) ~arranged radially in the wall that closes one end of (100)
(206) Junctions that connect each section of the recess (205) with the concentric annular rabbet (203)
(207) Pin to guide and position the insert (400)
(208) "Keyhole"/groove in rectangular cross-section of the outer cylindrical wall of (200)
(209) Reinforcement of the wall (208)
(210) "Keyhole"/groove cooperating with the guide (11) of gun (1)
(211) Beveled portion in the interior wall of the concentric annular rabbet (203)
(CR) Retractable contact pin
(300) Insert for the top end plate (100)
(301) Keyway slot for cooperation with pin (107)
(302) Spring for retractable contact (CR)
(400) insert for bottom end plate (200)
(401) Keyway slot for cooperation with pin (207)
(402) Holes for extraction of the insert
(403) Hole for the passage of wire
(500) J-shaped metal centering clip
(501) Straight larger section of each metal centering clip
(502) Elbow end of section (501) for anchorage in window (2') corresponding to charge carrier (2)
(503) Short straight section perpendicular to section (501) of each metal centering clip
(504) Curved section of each metal centering clip
(505) Terminal tab of section (504), to couple each metal centering clip to the edge of the outer wall of the end plate (100) and (200)

DETAILED DESCRIPTION OF THE INVENTION

The following is a detailed description of exemplary embodiments to illustrate the principles of the invention. The embodiments are provided to illustrate aspects of the invention, but the invention is not limited to any embodiment. As those skilled in the art will appreciate, the scope of the invention encompasses numerous alternatives, modifications and equivalent; it is limited only by the appended claims.

In relation to FIG. 1, the gun (1) is a steel tube, of treated material, with a charge carrier (2) inside. The carrier is a tube slightly smaller in diameter than the inner diameter of the gun (1) which has openings (3) for multiple shaped-charges (not shown), and mounted, at both ends, in centering end plates whose bodies are made of an insulating material; the top end plate (100) has a retractable contact (RC) and the insulating bottom end plate (200).

The end plates (100) and (200) are molded in plastic material, with a general cylindrical shape with a diameter greater than its height, the exterior of which has a cylindrical surface of an intermediate diameter between the inner diameter of the hollow cylinder (1), which constitutes the gun, and the outer diameter of the carrier's tube (2). Pieces (100) and (200) have peripheral means of centering the carrier (2), a corresponding passing central opening (101) and (201), and a corresponding concentric annular rabbet (103) and (203) of reciprocal fit with the corresponding end of the carrier (2).

In end plates (100) and (200), the passing central openings (101) and (201) are limited at one end by respective walls (102) and (202), which have axial holes (102') and (204') for the passage of wires (not shown). Said walls (102) and (202) constitute an insertion limit for corresponding inserts (300) and (400).

The cylindrical pieces that constitute the end plates (100) and (200) have, respectively, at least three straight peripheral recesses (104) and (204), parallel to the axis of the piece and arranged offset at 120°, prolonged within respective minor sections (105) and (205) radially extended in the wall that forms one of the ends of the piece and furnished with respective passages (106) and (206), which extend into the concentric annular rabbet (103) and (203), which fits in the corresponding end of the carrier (2).

A metal centering clip (500) is adapted to each of the above-mentioned recesses. All three metal centering clips (500) of each end plate constitute the self-centering means of the carrier (2) within the gun (1).

Each metal centering clip (500) has a general "J"-shape, comprised of a substantially straight long arm (501), and set parallel to the axis of the piece in the annular rabbet (103) and (203) against the inner wall of said rabbet, and at its end has an elbow abutment (502) to anchor the apparatus to its respective window (2') of the cylindrical wall of the carrier (2). The long arm (501) connects, through a short perpendicular section (503), with a minor curved arm (504) that terminates in a tab (505) to connect to the edge portion, or the outer wail, of the piece (100) or (200). In all cases, the long arm (501) goes through passage (106) or (206) of the end plate, and the short section (504) of the metal strip is adapted in the recess section (105) or (205) of said end plate. The curved arm (505) is adapted to the straight peripheral recess (104) or (204) of the end plate with an outward curvature to make tangential contact with the inner face of the gun's wall (1). In this way, the elastic properties of all three curved arms (505) constitute a means of auto-centering for the corresponding end plate.

In both end plates (100) and (200), the inner wail of the concentric annular rabbet (103) and (203), for fitting the corresponding end of the carrier (2), have a beveled section at one end (113) and (211) that enables, the placement of each metal clip within the end plate, by allowing elastic angular movement of the end of the corresponding arms (501), to favor the insertion of the elbow abutments (502) in the slots (2') of the carrier (2).

Figure 2:
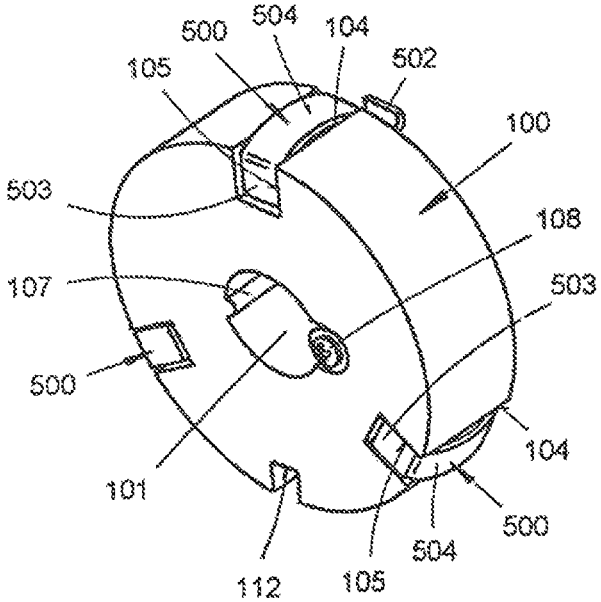
FIG. 2 is a perspective view of the top end plate.
Figure 3:
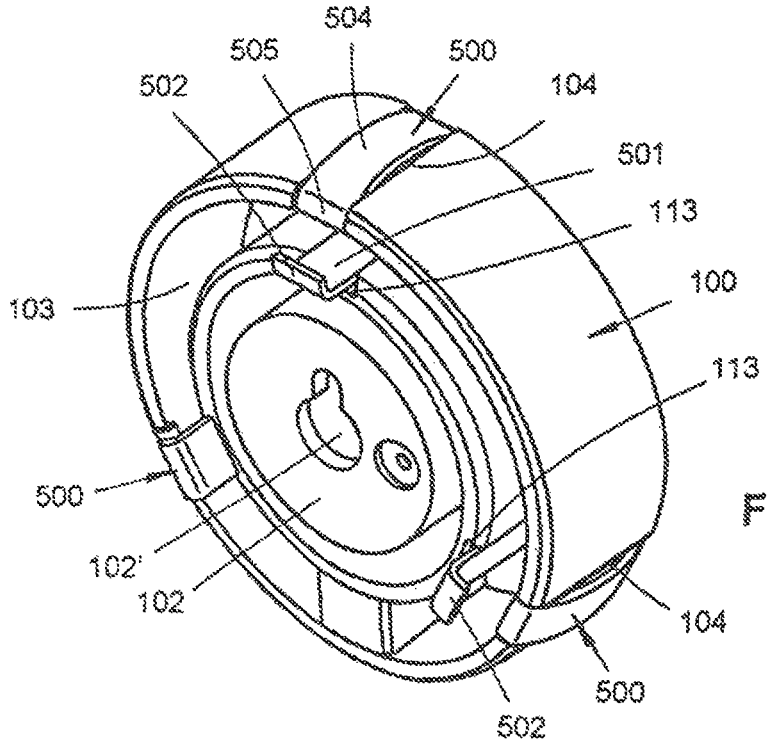
FIG. 3 is another perspective view of the top end plate of FIG. 2 from an opposing side.
Figure 4:
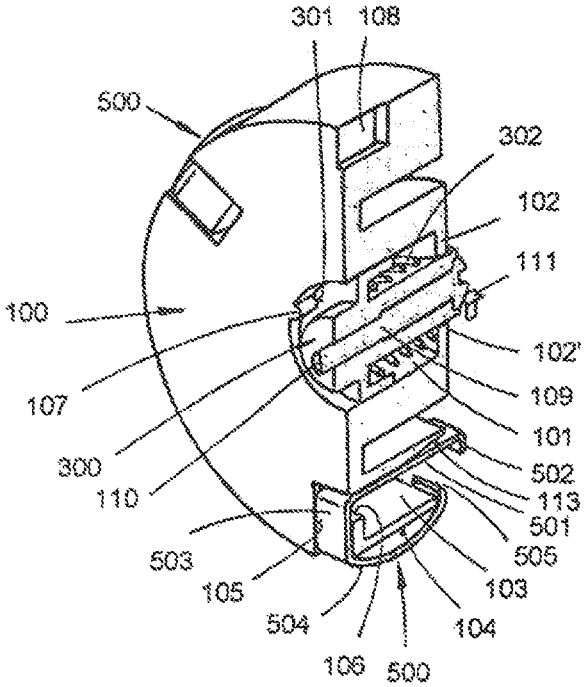
FIG. 4 is a cross-section perspective view of the top end plate with the respective retractable contact insert.
Figure 5:
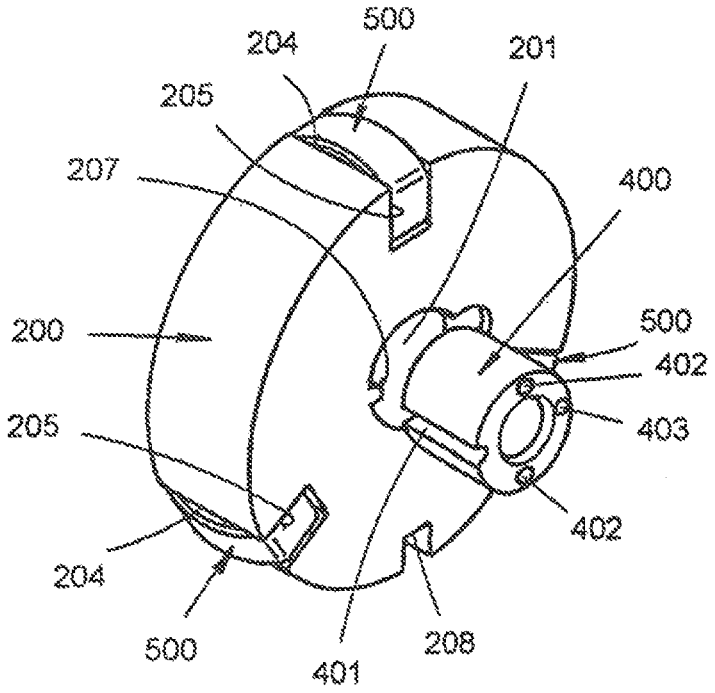
FIG. 5 is a perspective view of the bottom end plate with the respective central insert, shown in projection.
Figure 6:
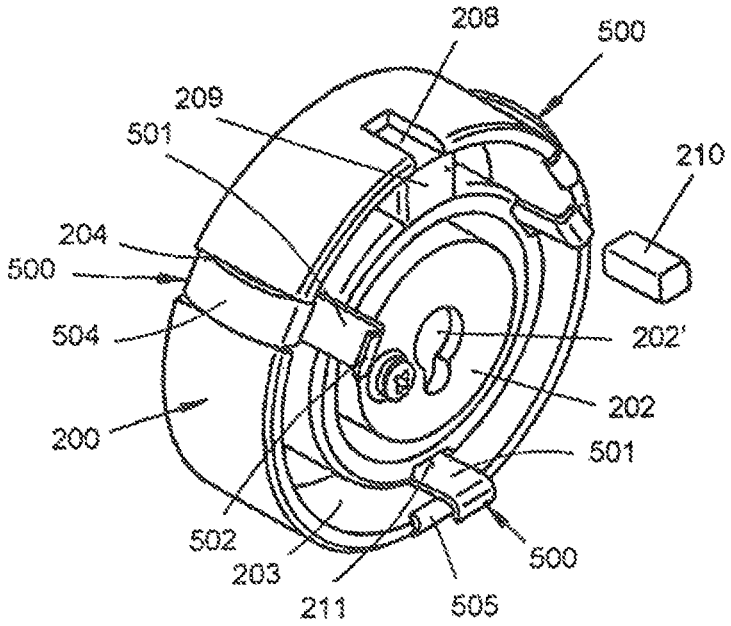
FIG. 6 is another perspective view of the bottom end plate of FIG. 5 from an opposing side.

For Wireline perforating (with wires), the upper end plate (100) is fitted with a retractable insert (300) for the contact pin (RC), triggered by a spring (302). The central cavity (101) of the end plate (100) has a pin used as a linear guide for the insert (300), the cylindrical wall of which has a corresponding "keyhole" (301). The body of the insert (300) is held within the cavity (101) by a stop screw (108) (FIG. 2). Located on the interior end of the retractable contact pin is a screw (109) whose tip (110) contacts the switch (not shown); the wire—crimped to a terminal (111)—carries the live charge to the contact of the connector (not shown) of the carrier (2).

The physical pressure of the metal centering dips (500) on the inside wall of the gun (1) electrically connects the carrier (2) to ground. With one wire connected to one of the metal centering clips (500) of the inner end plate (200) the ground is conducted to the connector (not shown) of the carrier (2).

The upper end plate has a "keyhole" (112) in its face with the largest diameter. When the charge carrier (2) is introduced to the gun (1), the "keyhole" (112) surrounds a pin (10) welded to the inside of one end of the gun (1); this fixes the carrier (2) to the gun (1) and guides the exit of each jet of the shaped charges (not shown) with the outer rabbet manufactured in each gun, called a "scallop".

In the lower end plate (200), the central cavity (201) has a guiding pin (207) to place the tubular insert (400), whose cylindrical wall has a keyway slot (401) with holes for extraction (402) with an appropriate tool, and a hole (403) for the wiring. In TCP operations, two of the orifice-type inserts (400) are used in each of the respective ends of the carrier assembly. In Wireline operations, the insert with retractable connecting pin (300) is used in conjunction with the orifice-type insert (400), each set within their respective ends, upper and lower, of the carrier tube.

Said lower end plate (200) has a rectangular keyhole (208), with a reinforcement (209) that prevents the end plate from being placed on the carrier in an incorrect fashion, in which the pin (210) is introduced. The pin anchors the charge carrier (2) inside a keyway guide (11) placed in the other end of the gun (1).

What is claimed is:

1. In explosive carrier end plates for charge-carriers utilized in guns for the perforation of petroleum producing wells, wherein each gun is vertically coupled with similar guns inside the casing of the well, and each gun is a hollow cylinder in which is located a corresponding carrier that holds explosive shaped-charges; and wherein the carrier is a tube having an outer diameter smaller than the inner diameter of the hollow cylinder, and having multiple peripheral mountings for radial placement of the shaped-charges which are in contact with a detonation cord that contacts an electrically-operated detonator; and wherein each carrier has mounted on the upper end thereof an upper end plate and on the lower end thereof, an insulating end plate with a retractable electrical spring contact capable of pushing upwards; the improvement comprising:

wherein each end plate comprises a cylindrical piece, each cylindrical piece having a cavity and a dominant diameter with a cylindrical surface whose diameter is intermediate to the inner diameter of the hollow cylinder and the outer diameter of the carrier tube, each cylindrical piece having a peripheral means for centering the carrier, a central opening passage, and a concentric annular rabbet that reciprocally fits with a corresponding end of the carrier; wherein the cylindrical piece of each end plate having at least three straight peripheral recesses parallel to the axis of the cylindrical piece and separated from each other in an equiangular fashion and extending radially in the wall formed by an end of the cylindrical piece and provided for the passage of a respective concentric annular rabbet that fits in the corresponding end of the carrier;

a "J"-shaped metal centering clip provided at each recess, having a substantially straight long arm with an elbow abutment for anchoring in a respective window of the cylindrical wall of the carrier and a minor curved arm with a terminal tab to hook on the edge portion of the outer wall of the cylindrical piece that matches the straight section of the recess;

said curved arm being of an elastic metal for self-centering the end plate and being tangentially in contact with an inner face of the wall of the gun, and providing electric contact between said carrier and the gun;

the cylindrical piece of each end plate having a central opening axially fitted with a single removable insert and presenting reciprocal guiding and positioning means that is congruent between the walls of said cavity and the corresponding insert; and the peripheral cylindrical wall of the cylindrical piece having means for positioning the cylindrical piece with the wall of the gun.

2. The improvement according to claim 1, wherein the respective central opening passage of each cylindrical piece of each end plate is limited at one end by a wall with an axial hole; said wall constituting an insertion limit for the corresponding insert.

3. The improvement according to claim 1, wherein each cylindrical piece has a cylindrical peripheral wall with a straight rabbet extending from one end of said wall with a length less than said wall, constituting a keyway slot that cooperates with a shaft secured to the wall of the gun, at one end of the inner face of said gun wall, thereby guiding the exit of each jet of the charge.

4. The improvement according to claim 1, wherein the inner wall of the concentric annular rabbet for receiving the corresponding end of the carrier-tube has a beveled end portion for placement of the centering clip.

5. The improvement according to claim 1, wherein one of the removable inserts is a cylindrical tubular piece in which is mounted a retractable contact pin, wherein the guiding and positioning means within the central opening of the end plate comprise a straight rib and a cooperating keyhole formed within the cylindrical wall of said removable insert.

6. The improvement according to claim 1, wherein one of the removable inserts is a tubular piece which has plural holes parallel to the axis of the tubular piece for receiving a tool to extract the tubular piece or to run wires, and wherein the means for guiding and positioning within the central opening of the end plate comprises a straight rib and a cooperating keyhole formed within the cylindrical wall of said removable insert.

7. The improvement according to claim 1, wherein the central opening passage of each cylindrical piece is axially fitted with the single removable insert, wherein the guiding and positioning means comprises a pin formed by a straight rib with a section cooperative with a peripheral slot of a keyway formed in the cylindrical wall of the corresponding insert, and wherein the pins and keyways of the pieces that form the inserts of the end plates are differentiated by size.

8. The improvement according to claim 5, wherein the central opening passage of each cylindrical piece is axially fitted with the single removable insert, wherein the guiding and positioning means comprises a pin formed by the straight rib with a section cooperative with a peripheral slot of a keyway formed in the cylindrical wall of the corresponding insert, and wherein the pins and keyways of the pieces that form the inserts of the end plates are differentiated by size.

9. The improvement according to claim 6, wherein the central opening passage of each cylindrical piece is axially fitted with the single removable insert wherein the guiding and positioning means comprises a pin formed by the straight rib with a section cooperative with a peripheral slot of a keyway formed in the cylindrical wall of the corresponding insert, and wherein the pins and keyways of the pieces that form the inserts of the end plates are differentiated by size.

* * * * *